US007384091B2

(12) United States Patent
Fukuda et al.

(10) Patent No.: US 7,384,091 B2
(45) Date of Patent: Jun. 10, 2008

(54) VEHICLE DOOR

(75) Inventors: Kensuke Fukuda, Anjo (JP); Toshiyuki Adachi, Anjo (JP); Katsuhisa Ishihara, Okazaki (JP); Atsuhiko Furukawa, Nagoya (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 63 days.

(21) Appl. No.: 11/443,277

(22) Filed: May 31, 2006

(65) Prior Publication Data

US 2007/0001479 A1 Jan. 4, 2007

(30) Foreign Application Priority Data

Jun. 29, 2005 (JP) ..... 2005-189833

(51) Int. Cl.
*E05B 3/00* (2006.01)

(52) U.S. Cl. ..... 296/152; 296/146.6; 296/1.02

(58) Field of Classification Search ..... 296/146.1, 296/146.2, 146.5, 146.9, 152, 1.02; 292/336.3, 292/DIG. 23, DIG. 30; 49/502, 503
See application file for complete search history.

(56) References Cited

U.S. PATENT DOCUMENTS 4,688,353 A * 8/1987 Almen ..... 49/460
5,860,684 A * 1/1999 Mizuki ..... 292/336.3
6,108,979 A * 8/2000 Saffran et al. ..... 49/503
6,401,302 B1 * 6/2002 Josserand et al. ..... 16/444
6,439,626 B1 * 8/2002 Rohlfing ..... 292/347
6,719,336 B2 * 4/2004 Sato ..... 292/336.3
6,883,840 B2 * 4/2005 Sueyoshi et al. ..... 292/336.3
7,029,054 B2 * 4/2006 Kobayashi et al. ..... 296/146.1
7,146,832 B2 * 12/2006 Mathofer ..... 70/208
7,168,755 B2 * 1/2007 Munezane ..... 296/152
7,226,096 B2 * 6/2007 Ito et al. ..... 292/336.3
2003/0011202 A1 * 1/2003 Kwak ..... 292/336.3
2003/0111850 A1 * 6/2003 Kwak ..... 292/336.3
2003/0218356 A1 * 11/2003 Emerling et al. ..... 296/146.1
2004/0125545 A1 * 7/2004 Kobayashi et al. ..... 361/600
2004/0222649 A1 * 11/2004 Ito et al. ..... 292/336.3
2005/0253413 A1 * 11/2005 Munezane ..... 296/146.1

FOREIGN PATENT DOCUMENTS

JP 2001-354035 A 12/2005

* cited by examiner

*Primary Examiner*—D. Glenn Dayoan
*Assistant Examiner*—Greg Blankenship
(74) *Attorney, Agent, or Firm*—Birch, Stewart, Kolasch & Birch, LLP

(57) ABSTRACT

A vehicle door comprises a door panel member having an outer panel, the outer panel having a concave portion which receives a user's hand, a handle member which is provided outside the outer panel and extends to cross the concave portion, a base member which is fixed on an internal surface of the outer panel and supports end portions of the handle member on both sides of the concave portion, the base member being formed to have a shape of detouring around the concave portion and reaching from one end to the other end of the concave portion, within a range of a depth of the concave portion in a thickness direction of the door panel member.

5 Claims, 5 Drawing Sheets

VEHICLE DOOR

BACKGROUND OF THE INVENTION

1. Field of the Invention

The present invention relates to a vehicle door which is opened and closed with a handle device.

2. Description of the Related Art

Jpn. Pat. Appln. KOKAI Pub. No. 2001-354035 discloses an example of a handle device provided on a vehicle, for example, an automobile. This prior art comprises a grip handle being a handle member that releases the lock of a door lock mechanism, and a case being a base member that rotatably supports the grip handle.

Generally, vehicle doors comprise a door panel member, a door lock mechanism, and a handle device as described above and the like. The door panel member includes an outer panel facing the outside of the vehicle, and an inner panel facing the inside of the vehicle. The base member of the handle device is fixed on the internal surface of the outer panel, and contained inside the door panel member. In most vehicle doors having such a structure, a concave portion for easy insertion of the hand into the handle device is formed in a portion of the outer panel to which the handle portion is attached. Such a structure of the vehicle door is adopted in many types of vehicles.

However, in the above structure of the vehicle door, there is the problem that it is required to increase the distance between the inner panel and the outer panel enough to contain the base member inside he door panel member, and consequently the thickness of the door panel member is increased. Further, although only containing the base member does not much increase the thickness of the door panel member, it is necessary to also provide the concave portion in the portion to which the base member is attached. Therefore, increase in thickness of the door panel member is inevitable. The base member is required to retain a predetermined strength to support the handle member, and cannot be easily reduced in thickness. Due to the above circumstances, there is the problem that the door panel member is increased in thickness, and the space inside the vehicle is decreased.

The object of the present invention is to provide a vehicle door having a structure in which the base member is fixed on the internal surface of the outer panel, and the door panel member can be formed with a small thickness.

BRIEF SUMMARY OF THE INVENTION

A vehicle door according to the present invention comprises: a door panel member having an outer panel, the outer panel having a concave portion which receives a user's hand; a handle member which is provided outside the outer panel and extends to cross the concave portion; a base member which is fixed on an internal surface of the outer panel and supports end portions of the handle member on both sides of the concave portion, the base member being formed to have a shape of detouring around the concave portion and reaching from one end to the other end of the concave portion, within a range of a depth of the concave portion in a thickness direction of the door panel member.

According to the above structure, the base member detours around the concave portion, and thus it is possible to prevent the door panel member from increasing in thickness by the thickness of the base member, in comparison with a structure wherein the base member is fixed outside the concave portion of the door panel member. Further, since the base member is formed to be lower than the depth of the concave portion, the base member in the attached state does not go beyond the concave portion in the thickness direction of the door panel member. This structure prevents increase in thickness of the vehicle door caused by providing the base member inside the door panel member.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A vehicle to which a vehicle door according to the present invention is applied, such as an automobile, is explained below with reference to FIGS. 1 to 5. For convenience of explanation, the front, the rear, the left, the right, the top and the bottom are defined based on the moving direction and the gravity direction of the vehicle.

Figure 1:
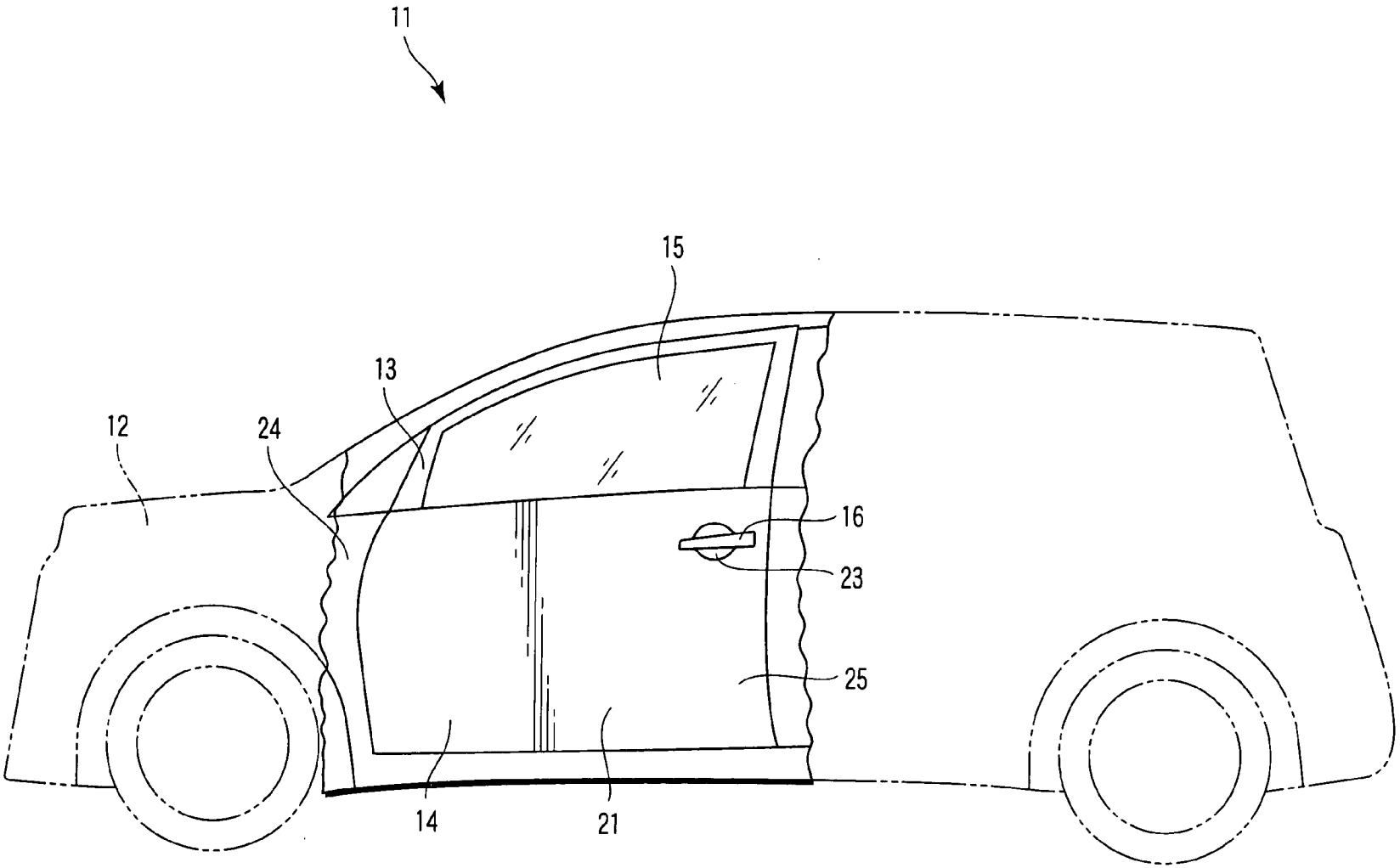
FIG. 1 is a front view of a vehicle door according to the present invention.

As shown in FIG. 1, an automobile 11 comprises a car body 12, and a plurality of vehicle doors 13 provided on side portions of the car body 12. FIG. 1 illustrates only one vehicle door 13 being a front door. The vehicle doors 13 are openable and closable by a door hinge member with respect to the car body 12.

Figure 4:
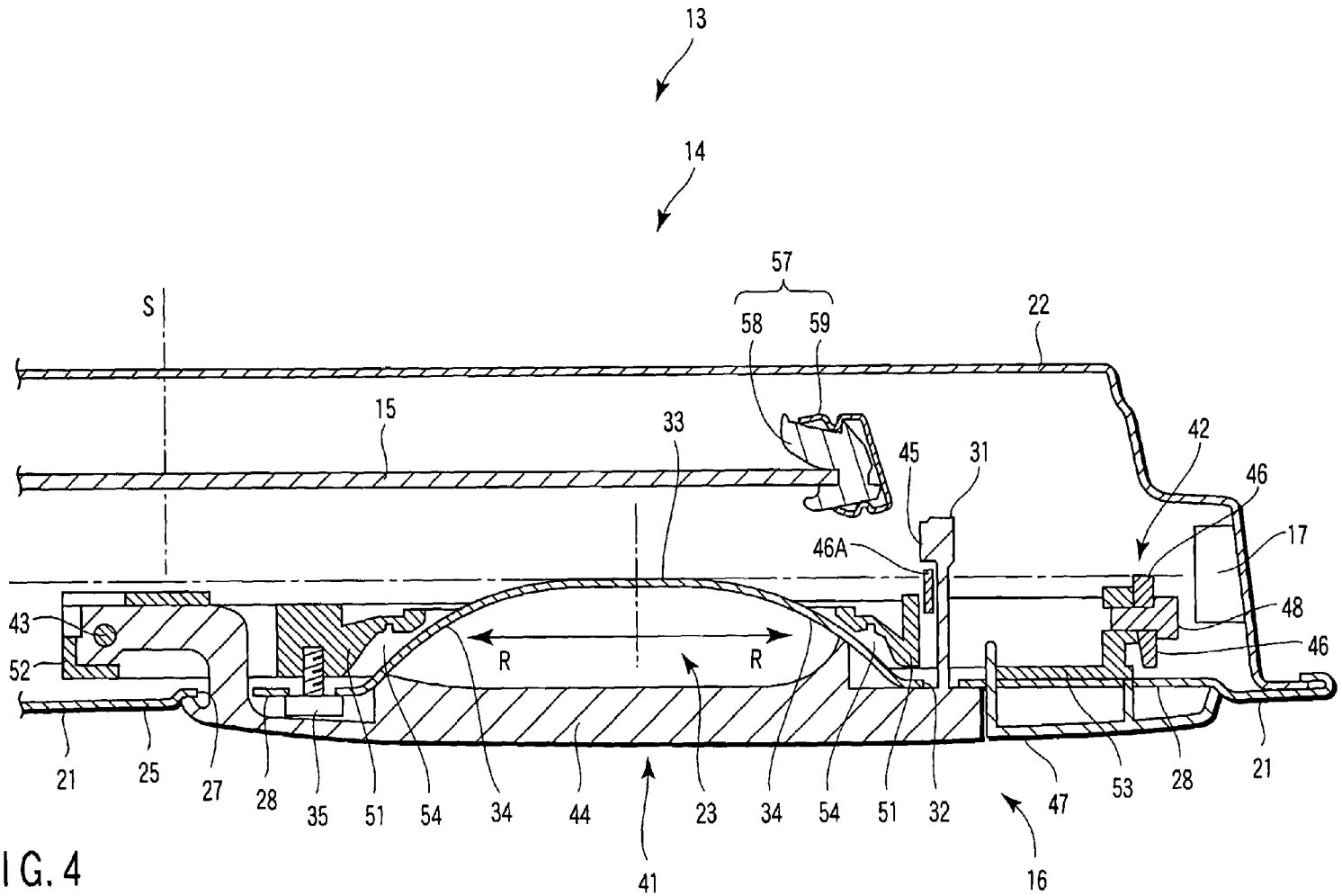
FIG. 4 is a cross-sectional view of the vehicle door, taken along F4-F4 plane shown in FIG. 2.

As shown in FIGS. 1 and 4, each vehicle door 13 comprises a door panel member 14, a door glass 15 being a window member, a handle device 16, and a door lock mechanism 17. The door panel member 14 has an outer panel 21 facing the outside of the vehicle, and an inner panel 22 facing the inside of the vehicle. The door panel member 14 has a box shape. As shown in FIG. 1, the outer panel 21 has a concave portion 23, and a body portion 25.

The door glass 15 is located in an upper half portion of the vehicle door 13. The door glass 15 is movable in a vertical direction with respect to the door panel member 14. The door lock mechanism 17 locks the vehicle door 13 in a closed state.

The handle device 16 is attached to a portion, which is close to the rear, of a side surface of the outer panel 21. The handle device 16 is connected to the door lock mechanism 17 being a latch, via an arm member 46 described below and a connecting member. The handle device 16 enables operation to lock and release the door panel member 14 by the door lock mechanism 17. The concave portion 23 is located in a position to which the handle device 16 is attached. The body portion 25 is located around the concave portion 23. The body portion 25 is flush with a body 24 of the car body 12.

Figure 2:
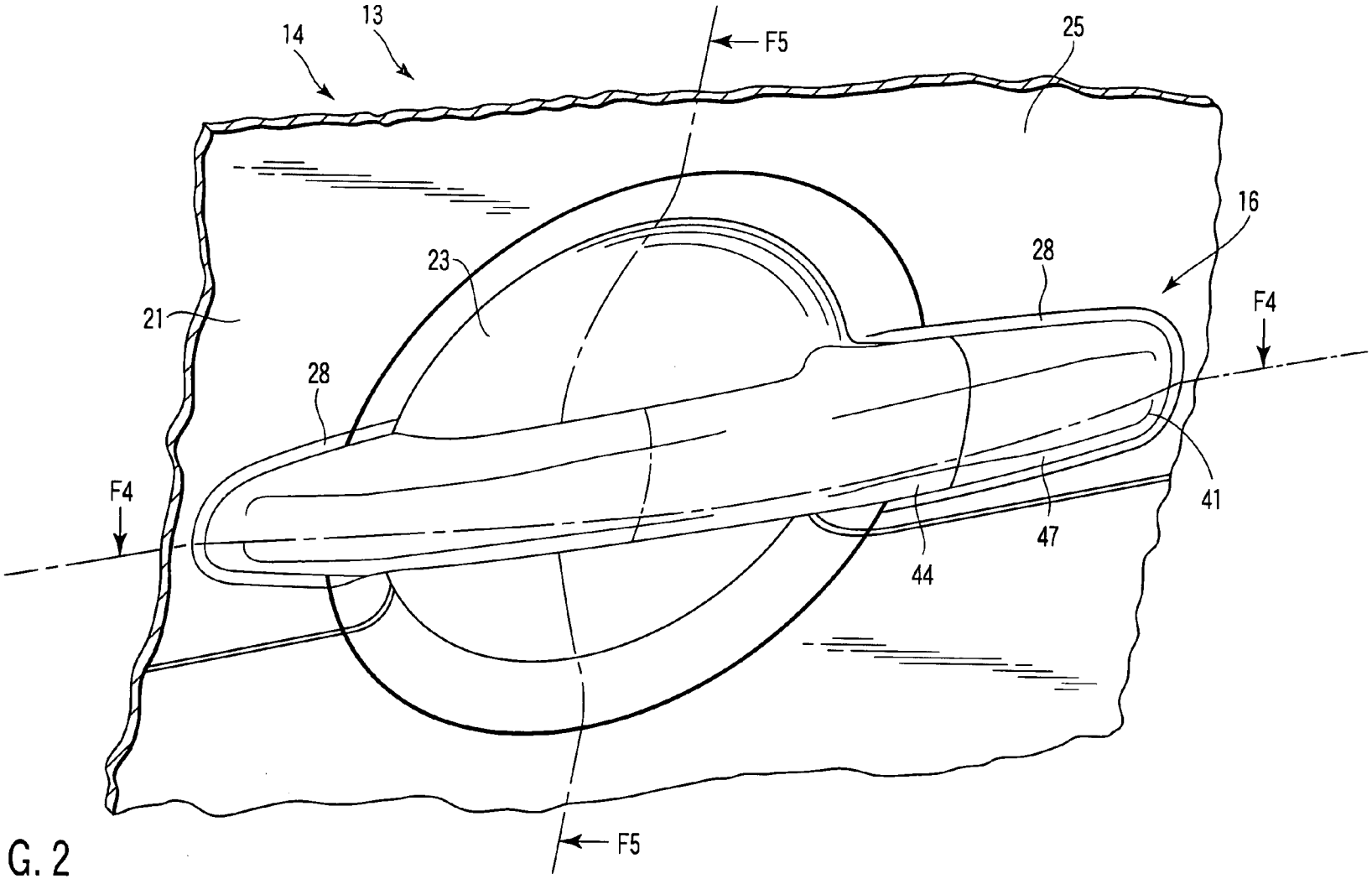
FIG. 2 is an enlarged perspective view of a handle device and its surroundings in the vehicle door illustrated in FIG. 1.
Figure 3:
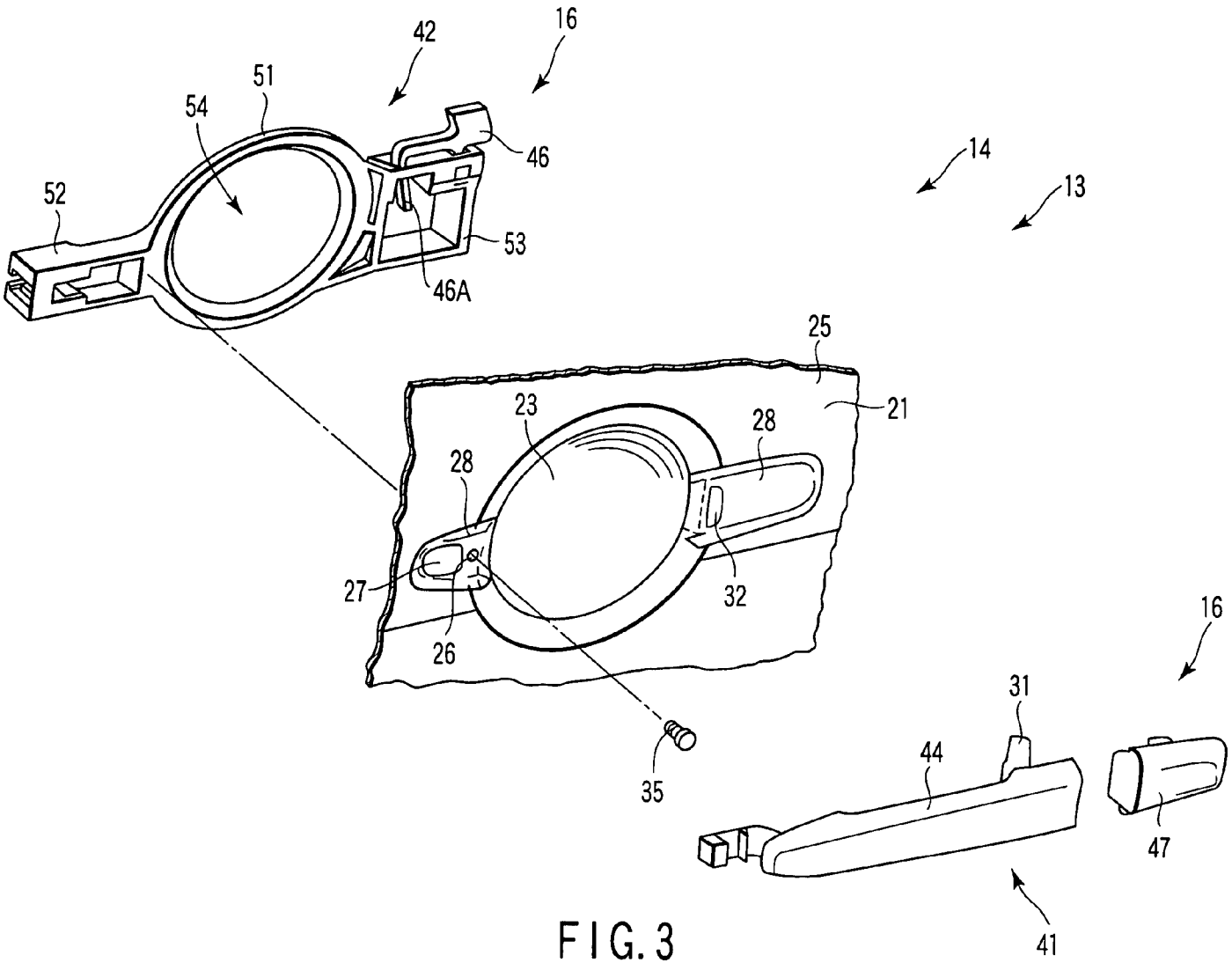
FIG. 3 is an exploded perspective view of the handle device illustrated in FIG. 2.

FIG. 2 is an enlarged perspective view of the handle device 16 and its surroundings in the vehicle door 13 illustrated in FIG. 1. FIG. 3 is an exploded perspective view of the handle device 16 illustrated in FIG. 2. As shown in FIGS. 2 and 3, the concave portion 23 has a hemispheric shape with a size enough to let the user's hand in. As shown in FIG. 3, a pair of depressed portions 28 serving as portions for attaching the handle device 16 are formed on the left and right sides of the concave portion 23.

Figure 5:
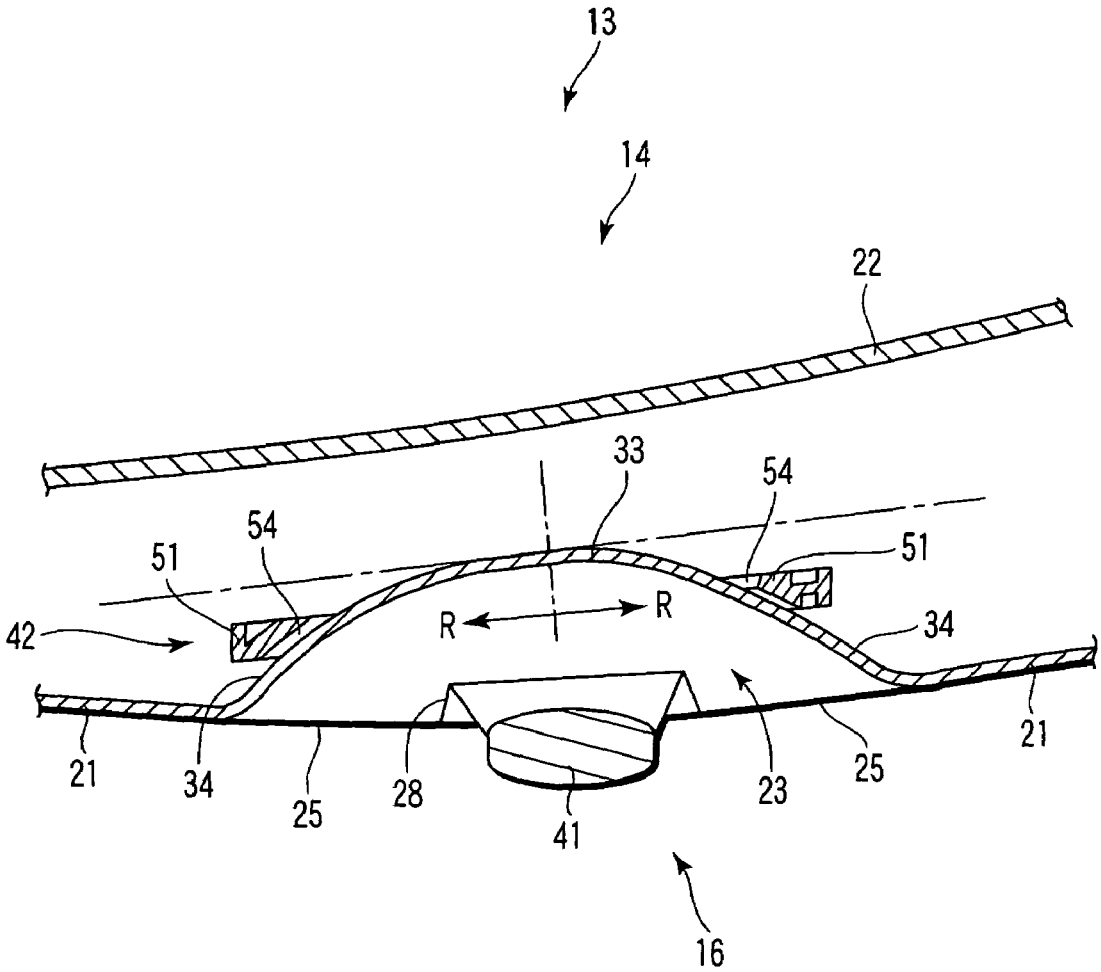
FIG. 5 is a cross-sectional view of the vehicle door, taken along F5-F5 plane shown in FIG. 2.

In FIG. 3, a screw hole 26 for inserting a screw and a communicating hole 27 into which the handle member 41 is inserted are formed in the left depressed portion 28 of the concave portion 23. Further, as shown in FIG. 3, an insertion hole 32 into which a lever member 31 described below is inserted is formed in the right depressed portion 28 of the concave portion 23. As shown in FIGS. 4 and 5, the concave portion 23 comprises a bottom portion 33 that is depressed to be closest to the inner panel 22, and a peripheral portion 34 that rises from the bottom portion 33 toward the body portion 25 and connects with the bottom portion 33 and the body portion 25.

As shown in FIG. 3, the handle device 16 is fixed onto the outer panel 21 by a screw 35. The handle device 16 comprises a handle member 41 serving as a holding portion in opening and closing, and a base member 42 which rotatably supports the handle member 41. The handle member 41 is disposed outside the outer panel 21. The base member 42 is fixed on a surface of the outer panel 21, which faces the inner panel 22. Specifically, the base member 42 is arranged inside the door panel member 14. As shown in FIG. 4, a hinge mechanism 43 which rotatably supports the handle member 41 is provided on the base member 42.

The handle member 41 has a bar shape that is gradually flattened towards its both ends, and is bowed overall. The handle member 41 extends from the front to the rear to cross the concave portion 23, and is disposed over the depressed portions 28. The handle member 41 has a fixing piece 47 which is fixed onto the outer panel 21, and a rotating piece 44 which rotates by the hinge mechanism 43. The fixing piece 47 has a length of ⅓ the whole length of the handle member 41, and is located in the rear. The rotating piece 44 has a length of ⅔ the whole length of the handle member 41, and is located in the front.

FIG. 4 is a cross-sectional view of the vehicle door 13, taken along F4-F4 plane shown in FIG. 2. As shown in FIG. 4, the rotating piece 44 is rotatably supported by the base member 42 through the hinge mechanism 43. The rotating piece 44 has, at a rear end portion, the lever member 31 which is a latch release lever extending in a thickness direction of the door panel member 14. The lever member 31 projects close to the inner panel 22 beyond the bottom portion 33. A tip portion of the lever member 31 has a hook portion 45 projecting toward the concave portion 23. A rotating end 46A of the arm member 46 described below is located between the hook portion 45 and the outer panel 21. Further, the lever member 31 limits a rotation range of the rotating piece 44.

As shown in FIGS. 3 and 4, the base member 42 is fixed onto the internal surface of the outer panel 21 from the inside of the door panel member 14. The base member 42 has a ring portion 51, a hinge supporting portion 52 adjacent to the ring portion 51, the hinge mechanism 43 supported by the hinge supporting portion 52, an arm supporting portion 53 adjacent to the ring portion 51 on the side opposite to the hinge supporting portion 52, and the arm member 46 supported by the arm supporting portion 53. The base member 42 supports the handle member 41 on the both sides of the concave portion 23 by the hinge supporting portion 52 and the arm supporting portion 53.

As shown in FIGS. 3 and 4, the hinge supporting portion 52 has a hole in its center in the thickness direction of the door panel member 14, and thus has a frame shape. The arm supporting portion 53 has a frame shape having a depth greater than that of the hinge supporting portion 52. The base member 42 is in close contact with the outer panel 21 at the arm supporting portion 53.

As shown in FIG. 4, the arm member 46 is rotatable around a hinge shaft 48 provided on the arm supporting portion 53. The arm member 46 is engaged with the lever member 31 of the handle member 41. The arm member 46 is connected to the door lock mechanism 17 by the connecting member. When the handle device 16 is pulled, the hook portion 45 of the lever member 31 is engaged with the rotating end 46A of the arm member 46, and the arm member 46 is rotated. When the arm member 46 is rotated, lock of the door panel member 14 by the door lock mechanism 17 is released.

The ring portion 51 has a circular ring shape, and detours upward and downward around the concave portion 23. A circular opening 54 is formed in the center of the ring portion 51. As shown in FIG. 4, the base member 42 is fixed onto the outer panel 21 in the state where the bottom portion 33 projects through the opening 54. The circumferential direction of the concave portion 23 in this state is denoted by arrow R shown in FIG. 4. The base member 42 in the state of being mounted on the outer panel 21 detours around the concave portion 23 in the circumferential direction R. The base member 42 has a shape of detouring around the concave portion 23 and reaching from one end of the concave portion 23, which corresponds to the hinge supporting portion 52, to the other end of the concave portion 23, which corresponds to the arm supporting portion 53, within a range of the depth of the concave portion 23 in the thickness direction of the door panel member 14.

In the embodiment, the base member 42 detours around the concave portion 23 by the ring portion 51 and the opening 54. However, the base member 42 may detour around the concave portion 23 by another shape, such as a notch portion provided in a portion interfering with the concave portion 23. Further, although the ring portion 51 has a circular shape in the embodiment, it is not limited to this shape, but may have another shape such as a rectangle. In this embodiment, the ring portion 51 has a circular shape, from the viewpoint of maintaining the strength of the base member 42 and preventing increase in thickness of the base member 42.

FIG. 5 is a cross-sectional view of the vehicle door 13, taken along F5-F5 plane shown in FIG. 2. A cross section of the ring portion 51 has a triangular shape in FIG. 4, and a trapezoidal shape in FIG. 5. Further, as shown in FIGS. 4 and 5, a surface of the ring portion 51 facing the concave portion 23 is formed in conformity with the shape of the concave portion 23.

As shown in FIGS. 4 and 5, the bottom portion 33 of the concave portion 23 penetrates the base member 42 through the opening 54. Therefore, as shown in FIGS. 4 and 5, the ring portion 51 of the base member 42 is formed with a height lower than the height (depth) of the concave portion 23 in the thickness direction of the door panel member 14, and arranged closer to the body portion 25 than the bottom is portion 33.

Further, both the hinge supporting portion 52 and the arm supporting portion 53 of the base member 42 are arranged closer to the body portion 25 than the bottom portion 33 is. Therefore, it is unnecessary to separately provide a space for setting the base member 42, and thus the distance between the outer panel 21 and the inner panel 22 is reduced.

As shown in FIG. 4, a sash 57 supporting the door glass 15 is arranged closer to the center S of the door panel member 14 than the lever member 31. The sash 57 includes a retainer 59, and a seal member 58 interposed between the retainer 59 and the door glass 15. Arranging the sash 57 closer to the center S of the door panel member 14 than the lever member 31 presents the sash 57 and the door glass 15 from interfering with the lever member 31.

According to the above embodiment of the automobile 11 to which the vehicle door 13 of the present invention is applied, the base member 42 is fixed to detour around the concave portion 23 in the circumferential direction R. Therefore, the base member 42 does not interfere with the concave portion 23, and increase in thickness of the door panel member 14 is prevented. Further, since the ring portion 51 is arranged along the concave portion 23, the base member 42 exhibits a sufficient stiffness against the door panel member 14.

Furthermore, the base member 42 has a height lower than the height (depth) of the concave portion 23, and is fixed in close contact with the outer panel 21 in the state where the bottom portion 33 projects through the opening 54. Thereby, even if the base member 42 is arranged inside the door panel member 14, the door panel member 14 is formed with the same thickness as that in the case where the base member 42 is arranged outside the door panel member 14.

Moreover, since the ring portion 51 is formed in conformity with the shape of the concave portion 23, it is possible to arrange the base member 42 to be closer to the outer panel 21. This structure realizes the thin door panel member 14 with a small thickness.

Further, since interference between the sash 57 and the lever member 31 is prevented, it is possible to arrange the sash 57 to be closer to the concave portion 23. This structure realizes the door panel member 14 with a small thickness. Using the vehicle door 13 according to the present embodiment enables ensuring a wide space in the vehicle.

Further, it is possible to form the concave portion 23 with a sufficient size, and improve the operability of the handle device 16.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A vehicle door, comprising:

a door panel member having an outer panel, the outer panel having a concave portion which receives a user's hand for handling a handle member for opening and closing the door from outside the vehicle;

the handle member which is provided outside the outer panel and extends to cross the concave portion; and a base member fixed on an internal surface of the outer panel and supporting end portions of the handle member on both sides of the concave portion, the base member being formed to have a shape of detouring around the concave portion and enabling the one end to communicate with the other end of the concave portion, wherein a thickness of the base member, fixed on the internal surface of the outer panel, in a thickness direction of the door panel member is smaller than a depth of the concave portion, such that the base member is arranged closer to the side of a body portion which is located around the concave portion than a deepest portion of the concave portion.

2. A vehicle door according to claim 1, wherein the base member is formed in conformity with a shape of the concave portion.

3. A vehicle door according to claim 2, wherein a portion of the base member, which detours around the concave portion, is formed of a ring portion having an opening through which the concave portion projects.

4. A vehicle door according to claim 1, wherein the handle member is movable and has a lever member for latch release, which releases a lock of a door lock mechanism, the lever member being inserted through an insertion hole of the outer panel and projecting into a position deeper than the depth of the concave portion.

5. A vehicle door according to claim 4, further comprising:

a window member which is accommodated in a door panel member and movable in an upper an lower direction of a car body; and a sash member supporting the window member, wherein the sash member is arranged to be closer to a center of the door panel member than the lever member in a front and rear direction of the vehicle that the window member extends.

* * * * *